United States Patent [19]

Radowicz

[11] 3,938,467

[45] Feb. 17, 1976

[54] END JOINTED BEAM AND LAMINATED BEAM ADHESIVE APPLICATION SYSTEM AND HEAD FOR USE THEREIN

[76] Inventor: Richard D. Radowicz, 25860 Rancho Alto, Carmel, Calif. 93921

[22] Filed: Jan. 17, 1974

[21] Appl. No.: 434,087

[52] U.S. Cl. ..... 118/2; 118/411; 156/357; 156/366; 156/546; 156/578

[51] Int. Cl.[2] ..... B65C 11/04

[58] Field of Search ..... 156/304, 578, 356–357, 156/366, 546–551, 544; 118/203, 410, 411, 2, 3

[56] References Cited

UNITED STATES PATENTS

| | | | |
|---|---|---|---|
| 3,224,411 | 12/1965 | Blaha | 118/411 X |
| 3,274,043 | 9/1966 | Schneider | 156/357 |
| 3,292,191 | 12/1966 | Kamborian | 118/410 X |
| 3,388,020 | 6/1968 | Gates | 156/578 |
| 3,523,852 | 8/1970 | Guerrero | 156/366 X |
| 3,682,751 | 8/1972 | Gebhardt et al. | 156/544 X |

*Primary Examiner*—Douglas J. Drummond
*Assistant Examiner*—David A. Simmons
*Attorney, Agent, or Firm*—Flehr, Hohbach, Test, Albritton & Herbert

[57] ABSTRACT

System and application head for depositing adhesives on surfaces to be bonded. The system includes a supply of adhesive and a pump for urging the adhesive through an outlet line leading from the adhesive supply. A regulator is situated in the adhesive outlet line to provide a substantially constant pressure in the adhesive flow to the downstream system components. An adhesive valve controls delivery of the adhesive to the application head. Means are provided for sensing when the surface to be bonded is in position adjacent to the application head to actuate a timer for controlling the valve whereby adhesive flows to the head for a predetermined period of time. Reverse pressure is then imposed to withdraw adhesive from the application head. The adhesive is deposited on the surface to be bonded during the time when the application head and the surface to be bonded are in cooperation. The head includes internal passages for directing adhesive therethrough to be applied to the surfaces to be bonded. An automatic flushing feature may be included upstream of the adhesive valve for fast removal of fast curing adhesives from the system after application thereof.

13 Claims, 7 Drawing Figures

BEAM POSITION SENSOR
TIMER
AUTOMATIC FLUSH SYSTEM
ADHESIVE SUPPLY
ADHESIVE PUMP
PRESSURE REGULATOR
ADHESIVE VALVE
FAST CURE AGENT
HEAD

END JOINTED BEAM AND LAMINATED BEAM ADHESIVE APPLICATION SYSTEM AND HEAD FOR USE THEREIN

BACKGROUND OF THE INVENTION

The present invention relates to a system for applying adhesives to end jointed or laminated beams and more particularly to an adhesive application system which deposits metered amounts of adhesive in well defined predetermined areas.

In the past, adhesive application systems have used disc rollers for depositing adhesives on surfaces to be bonded in beam end joining processes. No control was exercised over the amount of adhesive applied so that an excess amount of adhesive was delivered to the bonding surfaces by the application head, resulting in an accumulation of adhesive on adjacent beam surfaces where bonding was not intended. The delivery of excess adhesive to surfaces to be bonded both increases adhesive consumption and causes jointed assemblies in storage to bond to adjacent assemblies, requiring extra labor to thereafter separate them. In prior art methods an attempt was made to retrieve the excess adhesive for recirculation in the adhesive application system. This allowed contaminants to enter the adhesive stream and in some instances physical damage was imparted to the adhesive through shear forces imposed during pumping, thus materially reducing the adhesive characteristics.

A new system and application head is needed which precisely meters adhesive to the surface to be bonded, precluding the necessity for an adhesive recovery and recirculation system.

SUMMARY AND OBJECTS OF THE INVENTION

Surfaces to be bonded in jointed or laminated assemblies have specified contours upon which adhesive is deposited over predetermined areas by an application head having a contoured surface complimentary to that of the surface to be bonded. The application head has internal adhesive channels extending between the application head contoured surface and an adhesive plenum chamber. A quantity of adhesive is delivered to the plenum chamber in the application head by actuating an adhesive valve for a predetermined period of time to allow adhesive to flow. The adhesive valve is controlled by sensing means which senses the proximity to the head of the surface to be bonded and operates a timer which opens the valve for the predetermined period of time. The valve is fed adhesive through a pressure regulated line supplied by adhesive pumped from an adhesive supply.

In general it is an object of the present invention to provide an adhesive application system and head which deposits adhesive over specific areas on a surface to be bonded.

Another object of the present invention is to provide an adhesive application system and head which leaves the surfaces adjacent the surfaces to be bonded free of adhesive.

Another object of the present invention is to provide an adhesive application system and head which does not require recovery and recirculation of excess adhesive.

Another object of the present invention is to provide an adhesive application system and head which may be used with various types and forms of adhesive.

Another object of the present invention is to provide an adhesive application system and head which deposits a predetermined amount of adhesive on the surface to be bonded.

Another object of the present invention is to provide an adhesive application system and head which requires a minimum amount of time and materials for cleanup and shutdown.

Another object of the present invention is to provide an adhesive application system and head which eliminates the introduction of contaminants to the adhesive flow and eliminates shear forces within the adhesive which degrade adhesive characteristics.

Additional objects and features of the invention will appear from the following description in which the preferred embodiment has been set forth in detail in conjunction with the accompanying drawings.

BRIEF DESCRIPTION OF THE PREFERRED EMBODIMENTS

Figures 1, 5, 6, 7:
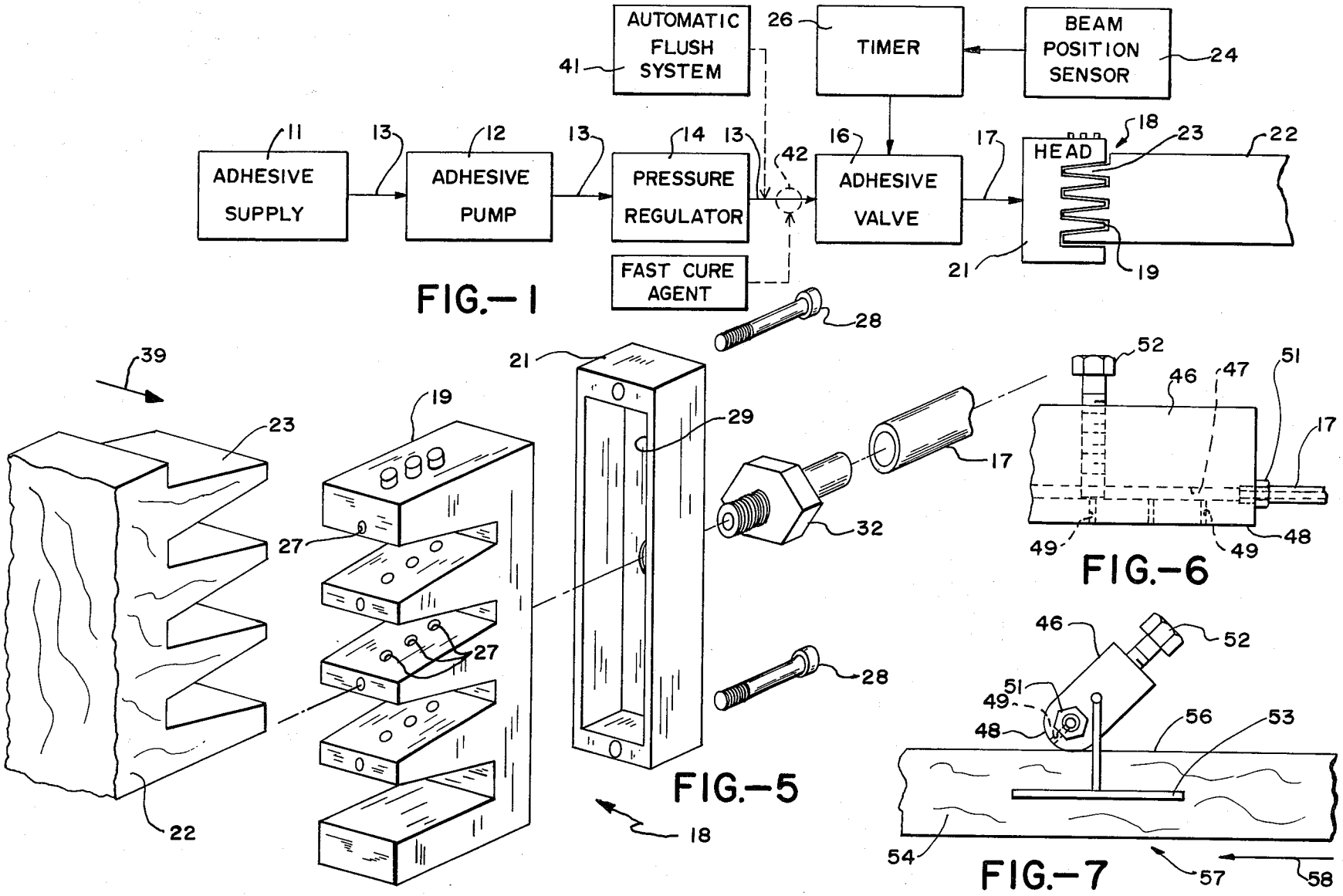
FIG. 1 is a block diagram of the adhesive application system including an end joint adhesive application head.
FIG. 5 is an isometric exploded assembly view of the end joint adhesive application head.
FIG. 6 is a front elevational view of a laminated joint adhesive application head.
FIG. 7 is a side elevational view of the laminated joint adhesive application head.

In FIG. 1 a system for applying adhesive to surfaces to be bonded in the fabrication of jointed beams or other bonded structures is shown. Adhesives from a supply 11 are pumped by an adhesive pump 12 through an outlet line 13. Outlet line 13 may include a pressure regulator 14 which maintains adhesive pressure at a predetermined level for delivery to an adhesive valve 16. Adhesive from valve 16 is delivered at a predetermined flow rate through line 17 to an adhesive application head 18 when pressure regulator 14 is used.

Application head 18 has a contour side 19 and a plenum chamber side 21. A beam 22 having a surface to be bonded 23 is shown in FIG. 1 in cooperation with adhesive head 18. Note that the contour side 19 of head 18 closely matches the contours of the surfaces to be bonded 23 on beam 22. A beam position sensor 24 detects beam 22 when the surface 23 is in close spaced relationship with the contour side 19 of adhesive head 18. An output signal from beam sensor 24 is connected to timer 26 which is connected to adhesive valve 16 opening valve 16 for a predetermined period of time.

Adhesive supply 11 may be a pressure tank fitted with outlet line 13 in which pump 12 is an air pump for providing pressure to move the adhesive from the supply 11 through outlet line 13. Assemblies of this type are available under the Trademark VANSCO, 10 series or 20 series adhesive supply and pump. Pressure regulator 14 in line 13 may also be obtained under the Trademark VANSCO for regulating adhesive pressure at a value anywhere within the 0 to 125 PSI range. Adhesive valve 16 may be of the air operated type offered under the Trademark VANSCO identified as 47–01 series actuator valves. The combination beam position sensor 24 and timer 26 is typified by Trademark VANSCO Model No. 46-01-01. Beam position sensor 24 has an adjustable feeler arm which is physically contacted by the beam 22 to actuate timer 26 when beam 22 moves across head 18 thereby causing adhesive to be deposited onto the surface to be bonded 23. The timer 26 may be adjusted to provide an actuating pneumatic force for a predetermined period in a range typically from 10 milliseconds to 2 seconds. Adhesive valve 16 is held open for the adjusted period of time. Since pressure regulator 44 delivers adhesive through line 13 to adhesive valve 16 at a predetermined flow rate, opening adhesive valve 16 for a predetermined period of time allows a predetermined volume of adhesive to flow through line 17 into the plenum side of adhesive application head 18. The metered volume of adhesive continues through head 18 to be dispensed over a predetermined area on the surface to be bonded 23.

Components in the adhesive application system shown in FIG. 1 need not necessarily be pneumatic. An electrical switch may be used for beam position sensor 24, and timer 26 connected thereto may be an electrically actuated device providing an electrical output signal. Adhesive valve 16 may also be electrically actuated to open for predetermined periods of time as directed by timer 26 and adhesive pump 12 may be electrically energized.

Figure 3:
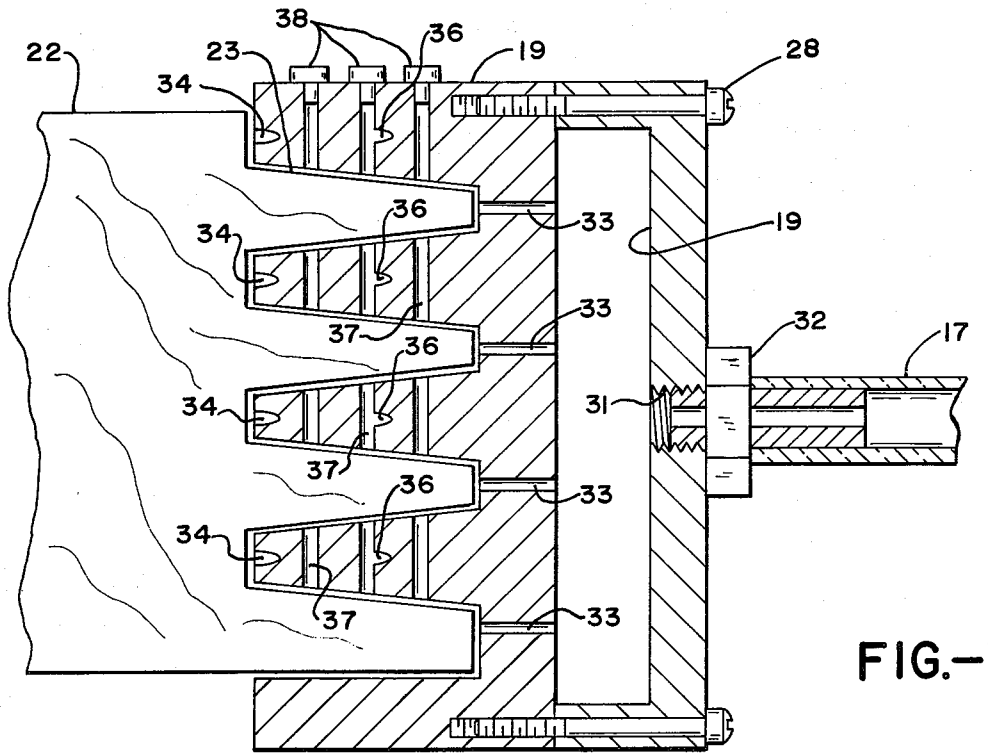
FIG. 3 is a side sectional view along the line 3—3 of FIG. 2.
Figure 2:
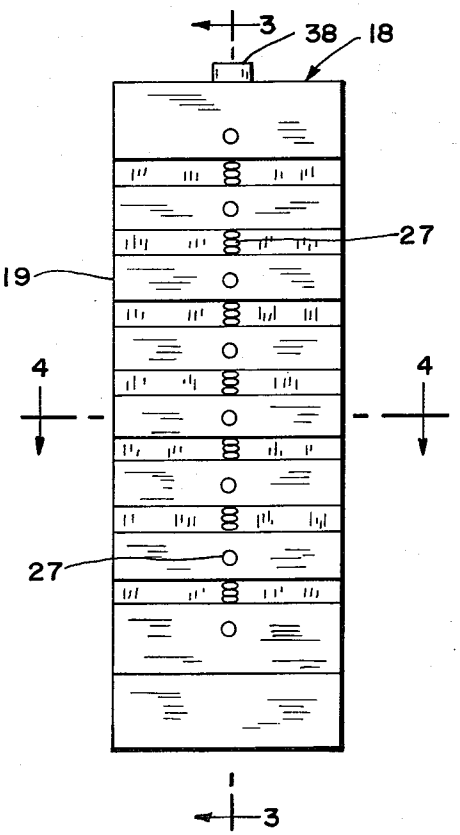
FIG. 2 is a front elevational view of an end joint adhesive application head.

In FIG. 2 a front view of adhesive application head 18 is seen looking into the contour side 19. Contour side 19 as seen in FIG. 3 is formed of a plurality of intercepting inclined and vertical planes having parallel lines of intersection describing fingers in this embodiment, and is complimentary to the surface to be bonded 23 which is shown on beam 22.

Referring to FIG. 2 again, a plurality of apertures 27 are shown centrally located in this embodiment for dispensing adhesive onto the surface to be bonded 23. In this embodiment three apertures are shown at each inclined plane of contoured surface 19 and one is shown intersecting each vertical plane. As may best be seen in the sectional view of FIG. 3 apertures 27 are at one of the ends of a plurality of channels through the contour side 19 of applicator head 18.

Plenum chamber side 21 of head 18 is formed to fit on the backside of contour side 19 by means of screws 28. A plenum chamber 29 is formed in plenum side 21 and an inlet hole 31 provides communication between plenum chamber 29 and the exterior of plenum side 21. A fixture 32 fits in inlet 31 providing an adaptor for affixing line 17 whereby adhesive from adhesive valve 16 is delivered to plenum chamber 29.

Figure 4:
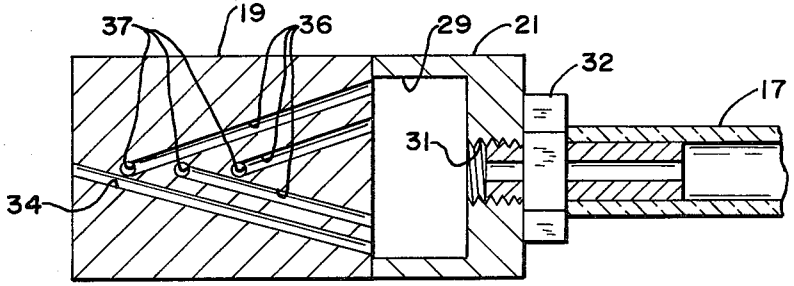
FIG. 4 is a top sectional view along the line 4—4 of FIG. 2.

A plurality of channels 33 extend from plenum chamber 29 to the root areas of the fingers shown on contour side 19. A plurality of channels 34 best seen in FIG. 4 extend from plenum chamber 29 to the tips of the fingers on contour side 19. Another plurality of channels 36 extend from plenum chamber 29 to a series of holes 37 formed perpendicular thereto and extending through the fingers on contour side 19. When holes 37 are drilled straight through the fingers on contour side 19 in one operation, plugs 38 are inserted in the ends thereof to prevent leakage of adhesive from head 18.

Apertures 27 are therefore all in communication with plenum chamber 29 through channels 33, 34, 36 and 37. In this fashion adhesive is delivered to the surface to be bonded 23 on beam 22.

It should be noted that if pressure regulator 14 is used, a predetermined adhesive flow rate will result for a given adhesive. In such case opening valve 16 for a predetermined time by timer 26 will provide for a predetermined volume of adhesive to be dispensed from head 18. If pressure provided by pump 12 is within an acceptable range, then regulator 14 may not be necessary. In either event adhesive is dispensed from head 18 onto surface 23 beginning at a point on the surface 23 as determined by sensor 24 and ending at a point on surface 23 as determined by timer 26 when beam 22 is in cooperation with contour side 19 of head 18.

An exploded assembly of the applicator head 18 is shown in FIG. 5 clearly displaying the plenum chamber 29 in plenum side 21 and the fingerlike contours in this embodiment on contour side 19. It should be noted that the fingerlike contour as best seen in FIG. 3 is formed specifically to fit the cut, ground, impressed, cast or molded contour on the surface to be bonded 23. The shape of contour side 19 is understood to assume a closely matching or complimentary shape to the shape of the surface to be bonded 23. This consideration will influence the number and placement of channels extending between plenum chamber 29 and apertures 27 on the surface of contour side 19 from which adhesive is dispensed.

Adhesive application head 18 may be mounted on an adjustable or fixed bracket (not shown) or may be mounted on a reciprocating shaft or circulating chain (not shown) for positioning and retracting the head 18 as required in some applications. In the embodiment seen in FIG. 5, beam 22 moves in the direction of arrow 39 and surface 23 passes in close spaced relation to the fingers on contour side 19 of head 18. Adhesive is dispensed from head 18 onto the surface to be bonded 23 beginning at a point on surface 23 determined by beam position sensor 24 and ending at a point on surface 23 determined by the time period set in timer 26. No excess adhesive remains on the contour side 19 after adhesive is dispensed because a back pressure is applied by a feature included in valve 16 at the end of the application timing cycle which draws excess adhesive through the channels in contour side 19 toward plenum chamber 29. Consequently there is no need for an excess adhesive recovery and recirculation system, thus eliminating the possibility for contaminants to enter the adhesive stream. The possibility for adhesive compound damage due to pumping shear forces and diminution of adhesive properties is also eliminated.

Adhesive is applied at the precise moment when applicator head orifices 27 and the surface to be bonded 23 are positioned in some predetermined position proximate to one another. In the disclosed embodiment adhesive is dispensed from orifices 27 after surface 23 has begun to pass by in the direction of arrow 39. A line or strip of adhesive is laid on surface 23 along the direction of arrow 39 from each orifice 27. Taking the relative velocity between beam 22 and head 18 into account, timer 26 is set to stop dispensing of adhesive from head 18 prior to passage of surface 23 by orifices 27. A nominal separation between the surface to be bonded 23 and the orifices 27 on contour side 19 has been found to be 0.012 inches. Since adhesive application is begun and stopped at precise points on surface 23 a control is afforded which allows substantially no adhesive to accumulate on other surfaces of beam 22.

The disclosed system and application head requires only a minimal amount of time and materials for cleanup and shutdown. A quart or so of water or solvent and one to two minutes of time is all that is required to clean the adhesive application head 18 because excess adhesive is not dispensed for buildup on surfaces from which it must be cleaned prior to drying. A quick wiping of the fingerlike members on contour side 19 would suffice for this embodiment.

Any type of adhesive may be used with the system disclosed herein, such as single or plural component adhesives, hot melt adhesives, or powder type adhesives. Hot melt type adhesives may require the addition of heat sources to the applicator head 18. The use of powder type adhesives may require changes to be made in the diameters of the channels through contour side 19 and the apertures 27. The use of fluid type adhesives normally requires channel diameters and diameters at apertures 27 of 0.05 inches nominal.

Another embodiment of the disclosed apparatus includes an automatic flushing system 41 which may be seen in FIG. 1. Flushing system 41 provides flushing agent to the system upsteam of the adhesive valve 16.

Automatic flushing is desirable when fast curing adhesives are being used. Typically such adhesives are two component adhesives which are mixed just upstream of the adhesive valve 16. Curing time is in the range of 2 to 30 minutes. Flushing is performed from the mixer 42 through all system components downstream thereof to prevent fouling of the system by the fast cure adhesive before normal cleanup is performed.

The system disclosed herein is useful for bonding laminated beam assemblies as well as end jointed beam assemblies. Applicator head 18 is specifically for one type of end jointed beam bonding application where the beam ends display the contour which is complemented by contour side 19 of head 18. FIG. 6 shows an applicator head 46 having a plenum chamber 47 and a contour side 48. Passages 49 communicate plenum 47 with contour side 48. A fitting 51, similar to fixture 32, fits in one end of plenum 47 providing an adaptor for affixing line 17 so that adhesive from adhesive valve 16 is delivered to plenum chamber 47. A plurality of valve bolts 52 are spaced along head 46 for longitudinal bolt adjustment between a closed and opened position for determining the length of plenum 47.

A guide bracket 53 depends from head 46 which is urged by means (not shown), such as a spring, into continuous contact with a surface 54 contiguous with a surface to be bonded 56 on a beam 57 as seen in FIG. 7.

Adhesive admitted into plenum 47 passes only through those passages 49 located upstream of the upstream valve bolt 52 which is closed. In this manner the width of a series of beads of adhesive from passages 49 applied to an adjacent surface to be bonded 56 is adjusted.

Passages 49 are typically .08 inches in diameter and may be spaced on .25 inch centers in one embodiment. Head 46 carries valve bolts 52 spaced so as to allow adjustment of adhesive dispensing from passages 49 to serve surfaces 56 to be bonded typically ranging from 2 to 12 inches in width.

Reference to FIGS. 6 and 7 shows that contour side 48 provides an application surface which is cylindrical in shape. Referring to FIG. 7 it is seen that, in the application position, head 46 is oriented relative to the surface 56 so that the openings of passages 49 through contour side 48 have one edge substantially tangent to surface 56. The system described heretofore, including beam sensor 24 and timer 26 operate to actuate adhesive valve 16 to supply adhesive to head 46 so that a bead of adhesive is laid on surface 56 for a predetermined length of beam 57. Guide bracket 53 maintains constant lateral relative position with beam 57 as beam 57 travels past head 46 in the direction indicated by arrow 58 in FIG. 7.

Applicator heads 18 or 46 may be of any material such as aluminum, brass, stainless steel, plastics, etc. A typical adhesive application head 18 for jointed beam applications may have a height of 2 inches. This is dependent on the thickness of the beam to be joined. The length of the head 18 from the inlet side to the application or contour side should be kept as short as possible to minimize fluid friction loss. A typical application head 46 for laminated beam applications may have a width of 11½ inches to serve beam section widths varying from 2 to 12 inches.

I claim:

1. A system for applying adhesive to surfaces to be bonded having specific contours comprising means for containing a supply of adhesive, an outlet line connected to said supply of adhesive, a pump for urging the adhesive to flow through said outlet line, an adhesive valve for receiving and metering the adhesive, means for controlling said adhesive valve to pass adhesive flow for a predetermined time, whereby a predetermined quantity of adhesive is passed therethrough, an adhesive dispensing head mounted for relative movement with the surfaces to be bonded and connected to receive said predetermined quantity of adhesive, application surfaces on said dispensing head being formed of intersecting planar surfaces having parallel lines of intersection and closely matching the contours of the surfaces to be bonded, said adhesive dispensing head having a plurality of channels therein for conveying said predetermined quantity of adhesive therethrough to be dispensed at said application surfaces, and including a plenum chamber for receiving said predetermined quantity of adhesive, said plurality of channels including at least one separate channel for said plenum chamber to each of said planar surfaces and means for sensing when said application surfaces are in a predetermined proximate position relative to the surfaces to be bonded, said last named means being connected to actuate said means for controlling, whereby the surfaces to be bonded receive said predetermined quantity of adhesive along a predetermined length thereof while adjacent surfaces are maintained free of adhesive.

2. A system for applying adhesive to surfaces to be bonded as in claim 1 wherein said adhesive valve includes means for causing reverse flow of adhesive in said dispensing head immediately following said predetermined period of time.

3. A system for applying adhesive as in claim 1 wherein said pump, adhesive valve and means for controlling are electrically actuated.

4. A system for applying adhesive as in claim 1 wherein said adhesive valve is pneumatically operated.

5. A system for applying adhesive as in claim 1 wherein said application surfaces have adhesive dispensing apertures formed therein by said plurality of channels, and wherein said means for sensing actuates said means for controlling when said adhesive dispensing apertures overlie a predetermined point on said surfaces to be bonded.

6. A system for applying adhesive as in claim 1 wherein said application surfaces and said surfaces to be bonded are spaced nominally twelve thousandths of an inch apart when adhesive is dispensed.

7. A system for applying adhesive as in claim 1 together with means for regulating adhesive pressure connected in said outlet line downstream of said pump, whereby said adhesive valve meters adhesive at a predetermined flow rate providing said predetermined quantity of adhesive when controlled open for a predetermined period of time by said means for controlling.

8. A system for applying adhesive as in claim 1 together with means for adjusting said predetermined time whereby said predetermined length may be adjusted to selected lengths of surfaces to be bonded.

9. A system for applying adhesive to surfaces to be bonded having specified contours comprising means for containing a supply of adhesive, an outlet line connected to said last named means, a pump for urging the adhesive through said outlet line, an adhesive valve for receiving and metering the adhesive, a timer connected to said adhesive valve for controlling said adhesive valve, an adhesive dispensing head connected to receive said metered adhesive, application surfaces on said dispensing head closely matching the contours of the surfaces to be bonded, said dispensing head having a plurality of channels therein for conveying said metered adhesive therethrough to be dispensed at said application surfaces, means connected to actuate said timer for sensing when said application surfaces are in cooperation with the surfaces to be bonded, whereby the surfaces to be bonded receive said metered adhesive while adjacent surfaces are maintained free of adhesive, means for mixing fast curing agents into said outlet line, and flushing means for providing flushing agent to said outlet line upstream of said means for mixing, whereby fast curing adhesive is flushed from said means for mixing, adhesive valve, and application head following application of adhesive.

10. A head for applying adhesive to a contoured surface to be bonded to a complementary surface and adapted to be connected to an adhesive supply having a constant adhesive flow rate, comprising first and second body members, said first body member having a surface substantially complementary to the contoured surface and having a plurality of intersecting planar surfaces, means in said second body member for receiving adhesive, means for joining said first and second body members together, said first body member having a plurality of channels extending between said means for receiving adhesive and said substantially complementary surface for dispensing adhesive therefrom, at least one of said plurality of channels extending from said means for receiving adhesive to each one of said planar surfaces, means associated with said first and second body members and the contoured surface for providing a constant velocity therebetween, and means for sensing when said substantially complementary surface is juxtaposed with the contoured surface, said last named means operating to cause a predetermined amount of adhesive to be uniformly dispensed along the contoured surface.

11. A head for applying adhesive as in claim 10 wherein said substantially complementary surface is positioned approximately 0.012 inches from the contoured surface for optimum application.

12. A head for applying adhesive to a contoured surface to be bonded to a complementary surface and adapted to be connected to an adhesive supply having a constant adhesive flow rate, comprising first and second body members, said first body member having a surface substantially complementary to the contoured surface, said substantially complementary surface having intersecting planar surfaces forming fingers, means in said second body member for receiving adhesive, said last named means including a plenum chamber, means for joining said first and second body members together, said first body member having a plurality of channels extending between said means for receiving adhesive and said substantially complementary surface for dispensing adhesive therefrom, including separate channels to each one of said planar surface, means associated with said first and second body member and the contoured surface for providing a constant velocity therebetween, and means for sensing when said substantially complementary surface is juxtaposed with the contoured surface, said last named means operating to cause a predetermined amount of adhesive to be uniformly dispensed along the contoured surface.

13. A head for applying adhesive as in claim 12 wherein said substantially complementary surface is positioned approximately 0.012 inches from the contoured surface for optimum application.

* * * * *